US010093330B2

(12) United States Patent
Seaton et al.

(10) Patent No.: US 10,093,330 B2
(45) Date of Patent: Oct. 9, 2018

(54) REMOTE LOCOMOTIVE ACCESS DETECTION

(71) Applicant: Progress Rail Locomotive Inc., LaGrange, IL (US)

(72) Inventors: James David Seaton, Westmont, IL (US); David Matthew Roenspies, Elburn, IL (US); Ola Tannous, La Grange Highland, IL (US)

(73) Assignee: Progress Rail Locomotive Inc., LaGrange, IL (US)

( * ) Notice: Subject to any disclaimer, the term of this patent is extended or adjusted under 35 U.S.C. 154(b) by 186 days.

(21) Appl. No.: 15/061,490

(22) Filed: Mar. 4, 2016

(65) Prior Publication Data

US 2017/0253259 A1 Sep. 7, 2017

(51) Int. Cl.
*B61L 27/04* (2006.01)
*B61L 23/00* (2006.01)

(52) U.S. Cl.
CPC ..... *B61L 27/04* (2013.01); *B61L 23/00* (2013.01); *B61L 2201/00* (2013.01)

(58) Field of Classification Search
CPC .. B61L 23/00; B61L 15/0027; B61L 15/0072; B61L 15/0018; B61L 2201/00; B61L 27/04; G08B 13/00; G08B 13/18; B60R 25/00; B60R 25/04
USPC ..... 246/167 R, 187 C, 122 R; 340/541, 340/545.1, 426.19, 426.26, 426.29, 429, 340/438, 539.13, 539.18, 539.26
See application file for complete search history.

(56) References Cited

U.S. PATENT DOCUMENTS

| | | | | |
|---|---|---|---|---|
| 4,041,470 | A | 8/1977 | Slane et al. | |
| 6,629,050 | B2 | 9/2003 | Modgil | |
| 2003/0159572 | A1 | 8/2003 | Downs | |
| 2015/0076290 | A1* | 3/2015 | Cooper | B61L 15/0027 246/167 R |
| 2016/0039439 | A1* | 2/2016 | Fahmy | B61L 27/0088 701/20 |

* cited by examiner

*Primary Examiner* — Mark T Le
(74) *Attorney, Agent, or Firm* — Miller, Matthias & Hull

(57) ABSTRACT

A detection system for a locomotive may include a plurality of sensors. An electronic control module may be in communication with, at least, the plurality of sensors and the locomotive. The control module may be configured to: monitor the plurality of sensors; receive an alert from one of the sensors of the plurality of sensors when one of the corresponding sensors is triggered; determine if the alert is a security concern; and operatively respond to the security concern by at least one of removing tractive effort to the locomotive, apply braking force to the locomotive, locking a door of the locomotive, locking a window of the locomotive, and transmitting a notification.

14 Claims, 4 Drawing Sheets

REMOTE LOCOMOTIVE ACCESS DETECTION

TECHNICAL FIELD

The present disclosure relates generally to locomotives and other rail vehicles and, more particularly, relates to systems and methods for detecting security concerns, related to such locomotives and vehicles, and operating responsively to such detections.

BACKGROUND

Trains generally include at least one locomotive and at least one non-powered rail vehicle. In some configurations, multiple locomotives may be arranged throughout the train such that the locomotives may be separated, individually or as a locomotive consist (a group of directly coupled locomotives), by one or more of the non-powered rail vehicles. In such an arrangement, one of the locomotives, regardless of where it is positioned along the train, may be designated as the lead or master locomotive. For being remotely positioned with respect to the other locomotives, a single locomotive or a locomotive consist that is arranged between non-powered rail vehicles along the train may be generally referred to as a remote locomotive or a remote locomotive consist.

Often times, remote locomotives, either individually or within a consist, may be unmanned and may be vulnerable to unauthorized access. As an example, during a normal operating scenario, all of the locomotives in the train may run a pre-departure test and security verification, which however, would require a staff member to walk the entire train to manually verify each locomotive and ensure security thereof. Moreover, even after such time consuming verification, a person who is determined to gain entry may attempt unauthorized access post-departure. While efforts have been made to implement a detection system to notify an operator on-board another locomotive, such detection systems may be responsively less effective in trains which utilize automated or semi-automated master locomotives.

United States Patent Application Publication No. 2015/0076290 (the '290 publication) discloses a detection system and method for a rail vehicle. The detection system of the '290 publication includes a control module that determines the occupancy status of a rail vehicle. When the control module determines that the occupancy status is "occupied" the control module may provide notification, of unauthorized entry and occupation of the rail vehicle, to another rail vehicle or an off-board location. The control module may also respond to an "occupied" status by disabling the operator interface on the rail vehicle that is determined to be occupied without authorization. While effective, the detection system of the '290 publication provides countermeasures in response to an "occupied" status determination that merely communicate notification of unauthorized occupation and/or disable the operator interface located onboard the rail vehicle.

SUMMARY

In accordance with an aspect of the disclosure, a detection system for a locomotive is provided. The detection system may include a plurality of sensors. An electronic control module may be in communication with, at least, the plurality of sensors and the locomotive. The control module may be configured to: monitor the plurality of sensors; receive an alert from one of the sensors of the plurality of sensors when one of the corresponding sensors is triggered; determine if the alert is a security concern; and operatively respond to the security concern by at least one of removing tractive effort to the locomotive, apply braking force to the locomotive, locking a door of the locomotive, locking a window of the locomotive, and transmitting a notification.

In accordance with another aspect of the disclosure, a locomotive is provided. The locomotive may include a frame. The frame may include a cab and an access structure. The cab may include a door and a window. A door lock may be operatively coupled to the door and a window lock may be operatively coupled to the window. A power system may be mounted to the frame. A wheel assembly may be in operable association with the power system and a brake system. A plurality of sensors may be disposed on the locomotive and may include one of a door sensor operatively coupled to the cab door, a window sensor operatively coupled to the window, a motion sensor disposed in the cab, and a pressure sensor disposed on the access structure. A control module may be in communication with the door lock, the window lock, the power system, the brake system, and the plurality of sensors. The control module may be configured to: monitor the plurality of sensors; receive an alert from one of the door sensor, the window sensor, the motion sensor, and the pressure sensor when one of the corresponding sensors is triggered; determine if the alert is a security concern; and operatively respond to the security concern by at least one of controlling the power system to remove tractive effort to the wheel assembly, controlling the brake system to apply braking force to the wheel assembly, controlling the door lock to lock the cab door, controlling the window lock to lock the window, and transmitting a notification.

In accordance with yet another aspect of the disclosure, a method of detecting and responding to a security concern on a locomotive is provided. The method may include the step of monitoring a plurality of sensors disposed on the locomotive. Another step may entail receiving an alert from at least one sensor of the plurality of sensors when the at least one sensor is triggered. Yet another step may entail determining if the alert is a security concern. A further step may include operatively responding to the security concern by at least one of removing tractive effort to the locomotive, apply braking force to the locomotive, locking the door of the locomotive, locking the window of the locomotive, and transmitting a notification.

These and other aspects and features of the present disclosure will be more readily understood upon reading the following detailed description when taken in conjunction with the accompanying drawings.

DETAILED DESCRIPTION

Figure 1:
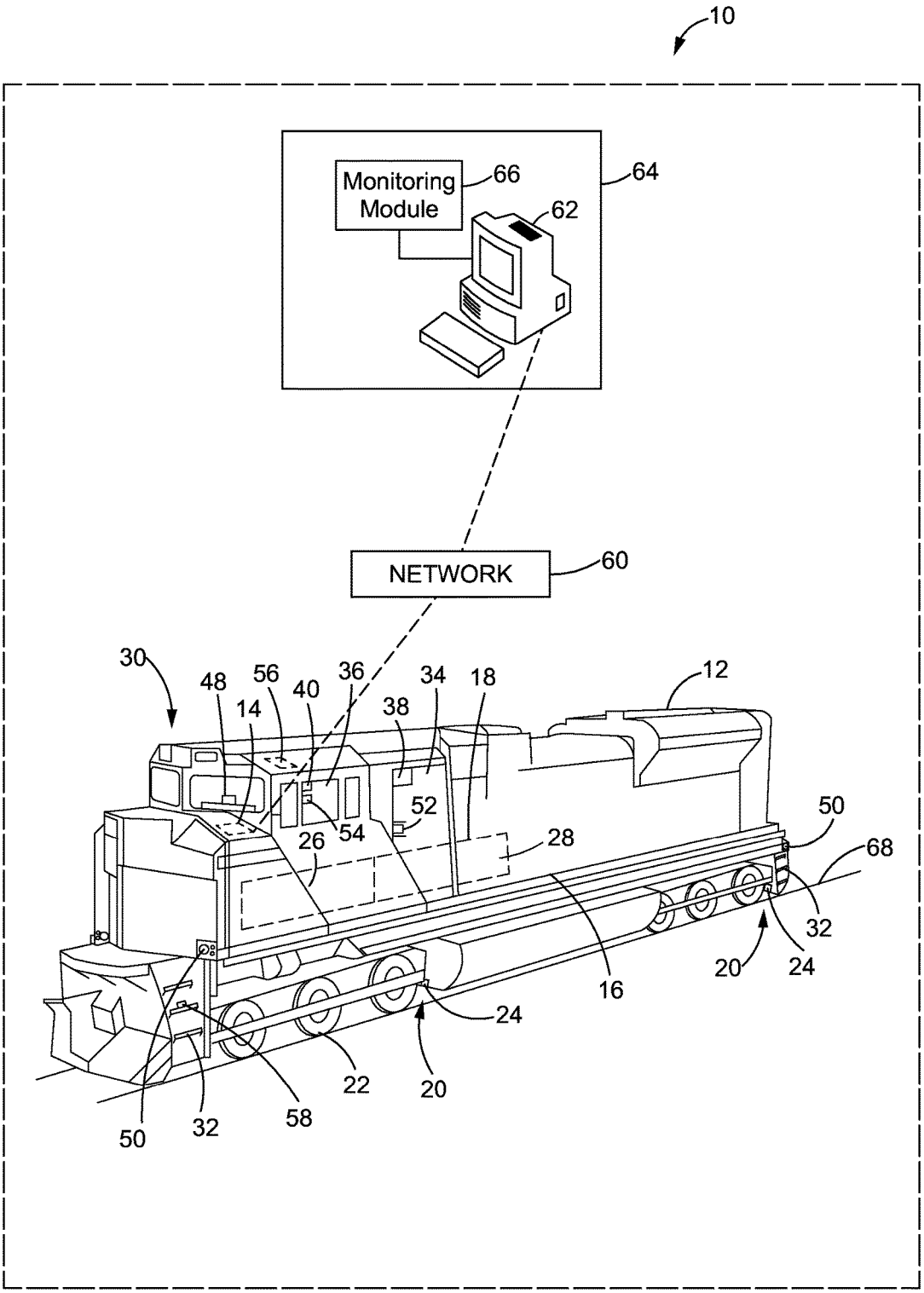
FIG. 1 is a schematic diagram of an exemplary detection system, in accordance with an embodiment of the present disclosure.

Referring now to FIG. 1, an exemplary detection system constructed in accordance with the present disclosure is generally referred to by reference numeral 10. The detection system 10 may detect security concerns onboard a locomotive 12 and operatively respond to such detections. The locomotive 12 may include a locomotive computing device 14. The locomotive 12 may also include a frame 16 and a power system 18 mounted to the frame 16. Moreover, the locomotive 12 may include a brake system 20 and a wheel assembly 22 in operable association with both the brake system 20 and the power system 18. The brake system 20 may be any appropriate brake system configured to apply braking force to the wheel assembly 22. In an embodiment, the brake system 20 may include at least air brakes 24, which may be implemented as penalty brakes that steadily deplete air until the full amount of braking effort may be applied to the wheel assembly 22 and thereby preventing movement of the locomotive 12. The power system 18 may be any appropriate power system configured to generate power to drive the wheel assembly 22 and provide tractive effort to propel the locomotive 12. In an embodiment, the power system 18 may include a high voltage system 26 and a power source 28, which may be, but is not limited to, a diesel engine.

The frame 16 may include a cab 30 and an access structure 32, which may be, but is not limited to, stairs and ladders. It should be understood that one or more access structures 32 may be arranged at the front, rear, and/or any position along both sides of the locomotive 12. The cab 30 may include a cab door 34 and a window 36. While the cab door 34 is depicted on the side of the locomotive 12 in FIG. 1, it should be understood that one or more cab doors 34 may be positioned at various locations including at the front of the cab 30 and/or on the other side of the locomotive 12. Similarly, more than one window 36 may be positioned at various locations on the cab 30. The cab door 34 may include a cab door lock 38, which may be activated to a locked position to secure the cab door 34 in a closed position. In an embodiment, the window 36 may include a window lock 40, which may be similarly activated to a locked position to secure the window 36 in a closed position.

Figure 2:
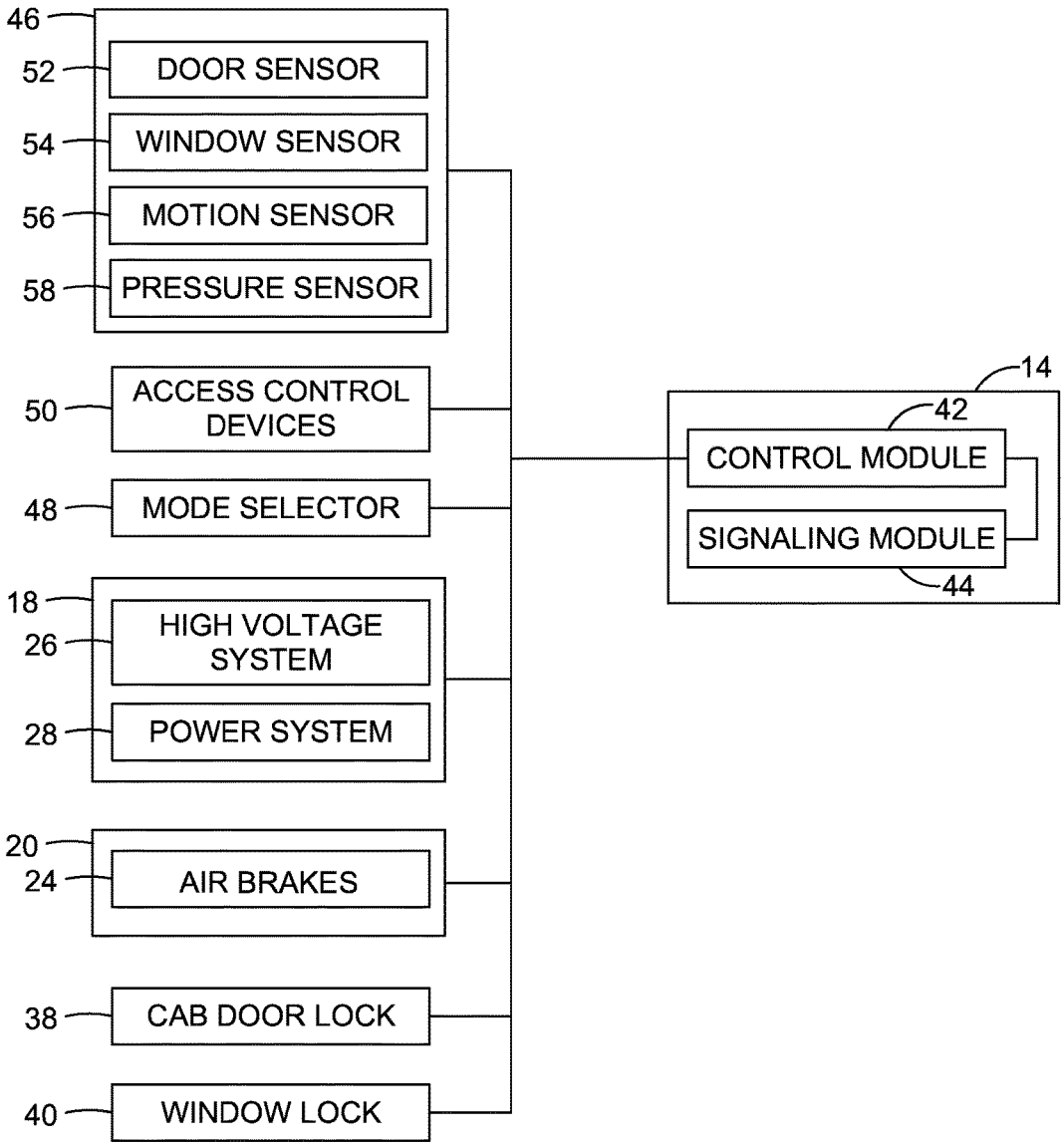
FIG. 2 is a block diagram illustrating details of the exemplary detection system of FIG. 1, in accordance with an embodiment of the present disclosure.

With reference to both FIGS. 1 and 2, the locomotive computing device 14 may be disposed in the cab 30 and may include a control module 42 and a signaling module 44. The control module 42 may be in communication with the signaling module 44, the power system 18 including the high voltage system 26 and the power source 28, the brake system 20 including the air brakes 24, the cab door lock 38, and the window lock 40. The control module 42 may be configured to determine a security concern onboard the locomotive 12 and responsively control functionality of the locomotive 12 based on the determination of such an existing security concern. As a non-limiting example, after determining a security concern exists onboard the locomotive 12, the control module 42 may responsively control, individually or in various combinations of, the power system 18 including the high voltage system 26 and the power source 28, the brake system 20 including the air brakes 24, the cab door lock 38, and the window lock 40.

The control module 42 may be in communication with a plurality of sensors 46 disposed at various locations on the locomotive 12, a mode selector 48 disposed in the cab 30, and a plurality of access control devices 50. The plurality of sensors 46 may include at least one of a door sensor 52, a window sensor 54, a motion sensor 56, and a pressure sensor 58. A door sensor 52 may be operatively coupled to the cab door 34 and may monitor the opening of the cab door 34. When the door sensor 52 detects the opening of the cab door 34, the door sensor 52 may transmit an open door signal or alert to the control module 42. In an embodiment, a door sensor 52 may be operatively coupled to each door onboard the locomotive 12 such as, but not limited to, other cab doors and doors for the high voltage system 26.

A window sensor 54 may be operatively coupled to the window 36 and may monitor the opening of the window 36. When the window sensor 54 detects the opening of the window 36, the window sensor 54 may transmit an open window signal or alert to the control module 42. In an embodiment, a window sensor 54 may be operatively coupled to each window 36 onboard the locomotive 12.

A motion sensor 56 may be disposed in the cab 30 and may monitor movement within the interior thereof. When the motion sensor 56 detects movement within the cab 30, the motion sensor 56 may transmit a movement detection signal or alert to the control module 42. A single motion sensor 56 or multiple motion sensors 56 may be selectively arranged within the cab 30 to effectively monitor the entire interior thereof.

A pressure sensor 58 may be disposed on the access structure 32 and may monitor a force applied thereto. The pressure sensor 58 may be any appropriate pressure sensor well known in the industry. When the pressure sensor 58 detects a force in excess of a pre-designated force, the pressure sensor 58 may transmit a force detection signal or alert to the control module 42. It should be understood that pressure sensors 58 may be disposed at various locations on the locomotive 12 such as, but not limited to, on other access structures 32, in the cab 30, and other desired locations.

The locomotive 12 may be selected, via the mode selector 48, to operate in one of manual mode, semi-automatic mode, and full automatic mode. The mode selector 48 may transmit a mode signal to the control module 42 indicative of the selected mode. The mode selector 48 may transmit the mode signal to the control module 42 via manual movement of a switch or via receipt of a command at an onboard or remote display (not shown). In manual mode, the locomotive 12 may be manned by an operator who manually controls the operations of the locomotive 12. In semi-automatic mode, the control module 42 may be configured to control some of the operations of the locomotive 12 while an operator, who may be onboard the locomotive 12 or remotely located, manually controls other operations of the locomotive 12 such as, but not limited to, auxiliary functions. In full automatic mode or automatic train operation (ATO), the control module 42, or a controller remotely located from the locomotive 12, may control functionality of the locomotive 12 instead of an operator.

Each access control device of the plurality of access control devices 50 may provide a safety feature for when the locomotive 12 should not be moved such as during an inspection or maintenance. Each access control device 50 may be configured to receive a status data, via an operator input, and may transmit the status data to the control module 42. The status data may be a blue flag status or a ready status. When the control module 42 receives the blue flag status, indicating the locomotive 12 should not be moved, the control module 42 may control, at least, the power system 18 and the brake system 20 to prohibit movement of the locomotive 12. After receiving the blue flag status, the control module 42 may also transmit a signal to the signaling module 44 such that the signaling module 44 may notify other systems that the locomotive 12 does not have authority to move. On the other hand, when the control module 42 receives the ready status, indicating the locomotive 12 is safe for movement, the control module 42 may control, at least, the power system 18 and the brake system 20 to permit movement of the locomotive 12. After receiving the ready status, the control module 42 may also transmit a signal to the signaling module 44 such that the signaling module 44 may notify the other systems that the locomotive 12 has authority to move. The plurality of access control devices 50 may be coupled to the locomotive 12 proximate the access structure 32, may be mobile or remotely located from the locomotive 12 such as, but not limited to, smart phones, lap top computing devices, tablet computing devices, and the like, or may be any combination thereof. Each access control device 50 may be in communication with each other either directly or indirectly.

With reference to FIG. 1, in an embodiment, the control module 42 may be in communication, via a network 60, with a monitoring computing device 62 remotely located from the locomotive 12 at an office 64. The monitoring computing device 62 may include a monitoring module 66 configured to receive and monitor information from the control module 42. The monitoring module 66 may be configured to function as a remote health and monitoring system for a railroad 68. The monitoring module 66 may also monitor the automatic train operation (ATO) status of the locomotive 12 via changes to the mode selector 48 and may transmit information or alerts to the control module 42.

The locomotive 12 may be coupled to at least one non-powered rail vehicle (not shown) forming a train and may be positioned anywhere along the train individually or as part of a locomotive consist. For example, the locomotive 12, individually or as part of a locomotive consist, may be arranged between non-powered rail vehicles along the train and as such may be referred to as a remote locomotive for being remotely located with respect to other locomotives in the train. Moreover, the locomotive 12 may be designated as the master locomotive such that it may control, whether by manual, semi-automatic, or full automatic operation, the braking, power distribution, and other train functions.

Figure 3:
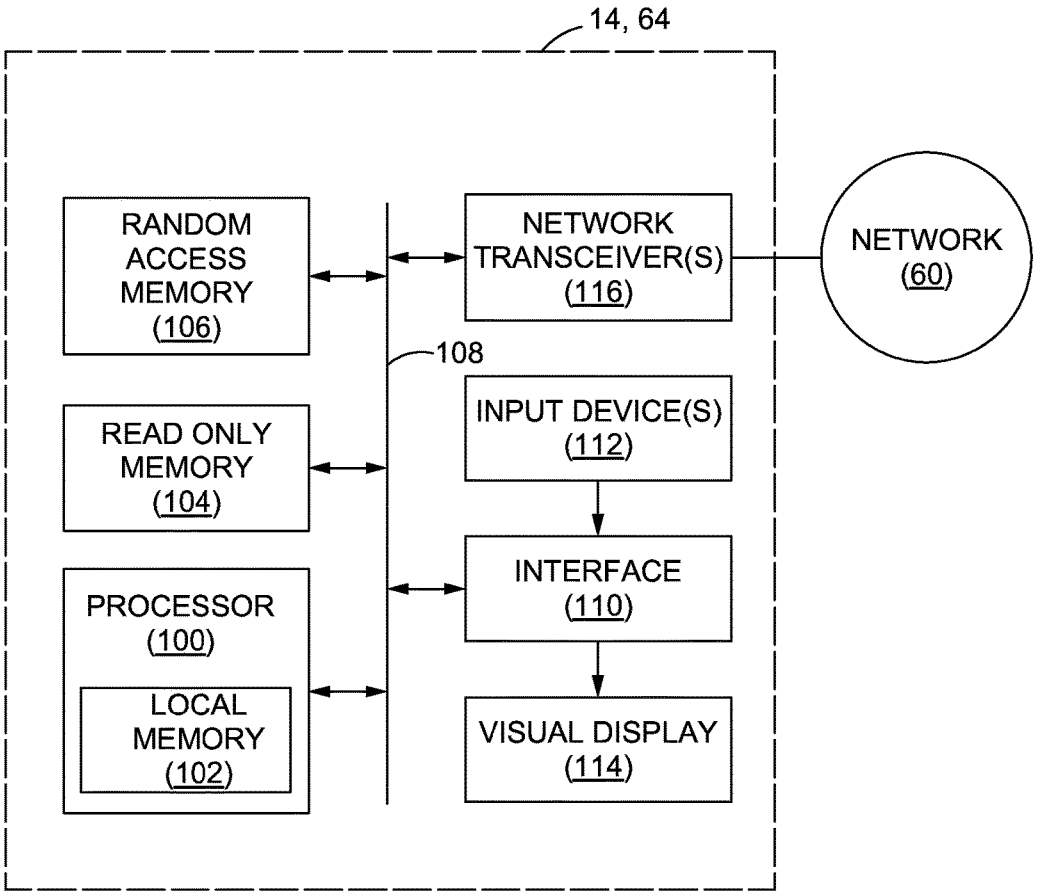
FIG. 3 is a block diagram illustrating components of an exemplary computing device, in accordance with an embodiment of the present disclosure.

FIG. 3 is a block diagram of example components of a computing device, such as locomotive computing device 14, the monitoring computing device 62, and/or any other computing device associated with the detection system 10, capable of executing instructions to detect security concerns onboard a locomotive 12 and operatively respond to such detections, as described below and/or capable of executing instructions to perform methods discussed below in reference to FIG. 4. Computing devices 14, 62 may include a processor 100 that may be, for example, implemented by one or more microprocessors or controllers from any desired family or manufacturer.

The processor 100 includes a local memory 102 and is in communication with a main memory including a read only memory 104 and a random access memory 106 via a bus 108. The random access memory 106 may be implemented by Synchronous Dynamic Random Access Memory (SDRAM), Dynamic Random Access Memory (DRAM), RAMBUS Dynamic Random Access Memory (RDRAM) and/or any other type of random access memory device. The read only memory 104 may be implemented by a hard drive, flash memory and/or any other desired type of memory device.

The computing devices 14, 62 may also include an interface circuit 110. The interface circuit 110 may be implemented by any type of interface standard, such as, for example, an Ethernet interface, a universal serial bus (USB), and/or a PCI express interface. One or more input devices 112 are connected to the interface circuit 110. The input device(s) 112 permit a user to enter data and commands into the processor 100. The input device(s) 112 may be implemented by, for example, a keyboard, a mouse, a track-pad, a trackball, and/or a voice recognition system. For example, the input device(s) 112 may include any wired or wireless device for providing input from a roaming operator to the computing devices 14, 62.

A visual display 114 may also be connected to the interface circuit 110. The visual display may be implemented by, for example, one or more display devices for associated data (e.g., a liquid crystal display, a cathode ray tube display (CRT), etc.).

Further, the computing devices 14, 62 may include one or more network transceivers 116 for connecting to the network 60, such as the Internet, a WLAN, a LAN, a personal network, or any other network for connecting the computing devices 14, 62 to one another and to one or more other computers or network capable devices.

As mentioned above the computing devices 14, 62 may be used to execute machine readable instructions. For example, the computing devices 14, 62 may execute machine readable instructions to perform the methods shown in the block diagram of FIG. 4 and described in more detail below. In such examples, the machine readable instructions comprise a program for execution by a processor such as the processor 100 shown in the example computing devices 14, 62. The program may be embodied in software stored on a tangible computer readable medium such as a CD-ROM, a floppy disk, a hard drive, a digital versatile disk (DVD), a Blu-ray™ disk, or a memory associated with the processor 100, but the entire program and/or parts thereof could alternatively be executed by a device other than the processor 100 and/or embodied in firmware or dedicated hardware. Further, although the example programs are described with reference to the block diagram illustrated in FIG. 4, many other methods of implementing embodiments of the present disclosure may alternatively be used. For example, the order of execution of the blocks may be changed, and/or some of the blocks described may be changed, eliminated, or combined.

INDUSTRIAL APPLICABILITY

In general, the present disclosure may find applicability in any number of industrial applications such as, but not limited to, rail and locomotive operations. By utilizing the systems and methods disclosed herein, security concerns onboard a locomotive may be detected and operatively responded to as countermeasures against such security concerns. More specifically, such systems and methods may be implemented to detect unauthorized access on an unmanned locomotive operating in full automatic mode and to provide countermeasures in response to such detections of unauthorized access.

In operation, the locomotive 12 may be part of a train and may be arranged between non-powered rail vehicles remotely from other locomotives in the train. The locomotive 12 may be unmanned and operating in full automatic mode or automatic train operation (ATO) mode. The control module 42 may be implemented to monitor the door sensor 52, the window sensor 54, the motion sensor 56, and the pressure sensor 58 such that when any of the sensors, 52, 54, 56, 58 are triggered the respective sensor may transmit an alert to the control module 42. For example, the door sensor 52 may be triggered when the cab door 34 is opened, the window sensor 54 may be triggered when the window 36 is opened, the motion sensor 56 may be triggered when the motion sensor 56 detects movement in the cab 30, and the pressure sensor 58 may be triggered when a force greater than a pre-determined force is applied to the access structure 32.

Moreover, with the locomotive 12 operating in ATO mode, the monitoring module 66 may monitor the mode selector 48 and may transmit an alert to the control module 42 when the mode selector 48 is changed from ATO mode to either manual mode or semi-automatic mode. Further, while the locomotive 12 is operating in ATO mode, the control module 42 should not receive any onboard manual inputs as this may be an indication that an authorized person is onboard the unmanned locomotive 12, therefore, the control module 42 may trigger an alert when it detects a manual input while in ATO mode.

After the control module 42 receives any of these alerts and determines a security concern has been detected, such as an unauthorized person onboard the locomotive 12, the control module 42 may operatively respond by, separately or in any combination of, controlling the high voltage system 26 to remove tractive effort to the wheel assembly 22, controlling the air brakes 24 to non-abruptly apply braking force to the wheel assembly 22, controlling the cab door lock 38 to lock the cab door 34, controlling the window lock 40 to lock the window 36, transmitting notification to the signaling module 44, and transmitting notification to the monitoring module 66.

The control module 42 may also monitor the access control devices 50, for example, to detect an authorized change from blue flag status to ready status while the locomotive 12 is stationary and prohibited from movement under the blue flag status protocols. When the locomotive 12 is stationary, the control module 42 may also monitor the mode selector 48 to detect any unauthorized changes thereto. In either scenario, if the control module 42 determines a security concern is detected, the control module 42 may operatively respond by, separately or in any combination of, controlling the high voltage system 26 to prohibit tractive effort to the wheel assembly 22, controlling the cab door lock 38 to lock the cab door 34, controlling the window lock 40 to lock the window 36, transmitting notification to the signaling module 44, and transmitting notification to the monitoring module 66.

Figure 4:
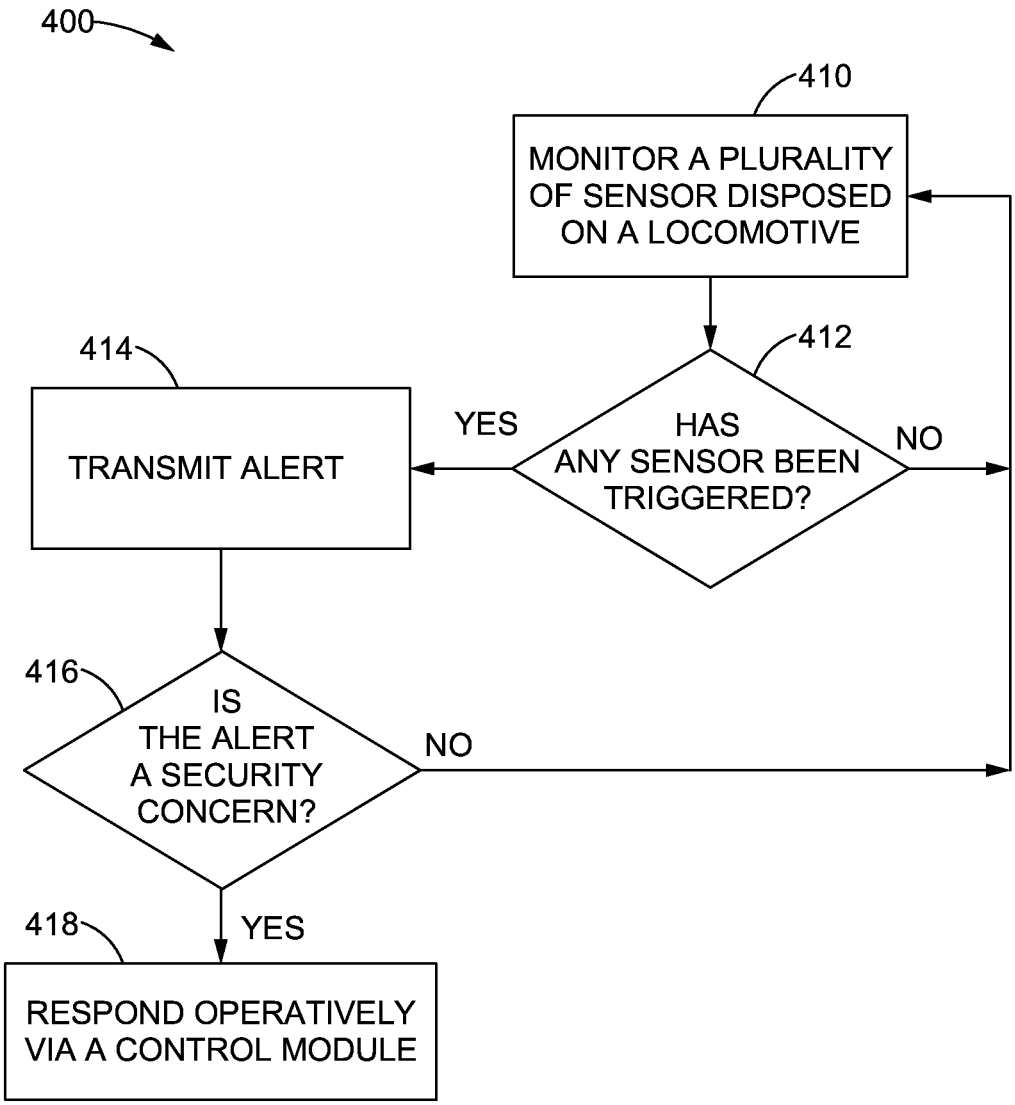
FIG. 4 is a flow chart illustrating a sample sequence of steps which may be practiced in accordance with an embodiment of the present disclosure.

FIG. 4 illustrates a flow chart 400 of a sample sequence of steps which may be performed to detect and respond to a security concern on a locomotive. The locomotive 12 may be a remote, unmanned locomotive. Box 410 illustrates the step of monitoring a plurality of sensors 46 disposed on the locomotive 12. A control module 42 may monitor the plurality of sensors 46. The plurality of sensors 46 may include a door sensor 52 coupled to a cab door 34, a window sensor 54 coupled to a window 36, a motion sensor 56 disposed in the cab 30, and a pressure sensor 58 disposed on an access structure 32. Decision box 412 illustrates the step of the control module 42 determining whether any of the sensors 52, 54, 56, 58 has been triggered. If it is determined that none of the sensors 52, 54, 56, 58 have been triggered, then the sensors 52, 54, 56, 58 may continue to be monitored, as illustrated by the return to box 410. If, however, it is determined that any one of the sensors 52, 54, 56, 58 has been triggered, then an alert may be transmitted to the control module 42, as depicted in box 414. As illustrated in decision box 416, after the control module 42 receives the alert, the control module 42 may determine whether the alert is security concern. If the control module 42 determines that the alert is not a security concern, then the sensors 52, 54, 56, 58 may continue to be monitored at box 410. If, however, the control module 42 determines that the alert is a security concern, then the control module 42 may operatively respond by, as illustrated in box 418, separately or in any combination of, controlling the high voltage system 26 to remove tractive effort to the wheel assembly 22, controlling the air brakes 24 to non-abruptly apply braking force to the wheel assembly 22, controlling the cab door lock 38 to lock the cab door 34, controlling the window lock 40 to lock the window 36, transmitting notification to the signaling module 44, and transmitting notification to the monitoring module 66.

What is claimed is:

1. A detection system for a locomotive, the detection system comprising:

a plurality of sensors disposed on the locomotive;

an electronic control module in communication with, at least, the plurality of sensors and the locomotive, the control module configured to:

monitor the plurality of sensors;

receive an alert from one of the sensors of the plurality of sensors when one of the corresponding sensors is triggered;

determine if the alert is a security concern; and operatively respond to the security concern by at least one of removing tractive effort to the locomotive, apply braking force to the locomotive, locking a door of the locomotive, locking a window of the locomotive, and transmitting a notification; and a plurality of access control devices in communication with the control module, the plurality of access control devices configured to transmit one of a blue flag status and a ready status to the control module for the control module to prohibit movement of the locomotive when the blue flag status is received and to permit movement of the locomotive when the ready status is received.

2. The detection system of claim 1, wherein the plurality of sensors includes one of a door sensor operatively coupled to the door of the locomotive, a window sensor operatively coupled to the window of the locomotive, a motion sensor disposed in a cab of the locomotive, and a pressure sensor disposed on an access structure of the locomotive.

3. The detection system of claim 1, further including a mode selector in communication with the control module, the mode selector configured to selectively transmit one of a manual mode signal, a semi-automatic mode signal, and a full automatic mode signal to the control module for operating the locomotive in a mode indicative of one of the mode signals.

4. The detection system of claim 3, further including a monitoring module in communication with the control module, the monitoring module is remotely located with respect to the control module and is configured to monitor the mode selector.

5. The detection system of claim 4, wherein the monitoring module is configured to transmit a mode alert to the control module when the mode selector is selectively changed to one of the manual mode signal and the semi-automatic mode signal while the locomotive is operating in the full automatic mode.

6. The detection system of claim 5, wherein the control module is configured to determine if the mode alert is the security concern.

7. The detection system of claim 6, wherein the control module is configured to operatively respond to the security concern by at least one of transmitting the notification to the monitoring module and transmitting the notification to a signaling module.

8. A locomotive comprising:

a frame including a cab and an access structure, the cab including a door and a window;

a door lock operatively coupled to the door;

a window lock operatively coupled to the window;

a power system mounted to the frame;

a wheel assembly in operable association with the power system;

a brake system in operable association with the wheel assembly;

a plurality of sensors disposed on the locomotive, the plurality of sensors including one of a door sensor operatively coupled to the door, a window sensor operatively coupled to the window, a motion sensor disposed in the cab, and a pressure sensor disposed on the access structure; and a control module in communication with the door lock, the window lock, the power system, the brake system, and the plurality of sensors, the control module configured to:

monitor the plurality of sensors;

receive an alert from one of the door sensor, the window sensor, the motion sensor, and the pressure sensor when one of the corresponding sensors is triggered;

determine if the alert is a security concern; and operatively respond to the security concern by at least one of controlling the power system to remove tractive effort to the wheel assembly, controlling the brake system to apply braking force to the wheel assembly, controlling the door lock to lock the door, controlling the window lock to lock the window, and transmitting a notification.

9. The locomotive of claim 8, further including a plurality of access control devices in communication with the control module, the plurality of access control devices configured to transmit one of a blue flag status and a ready status to the control module for the control module to prohibit movement of the locomotive when the blue flag status is received and to permit movement of the locomotive when the ready status is received.

10. The locomotive of claim 9, wherein at least one access control device of the plurality of access control devices is disposed on the exterior of the locomotive proximate the access structure.

11. The locomotive of claim 9, wherein at least one access control device is remotely located with respect to the locomotive.

12. The locomotive of claim 8, further including a signaling module in communication with the control module, the signaling module configured to receive the notification from the control module.

13. The locomotive of claim 8, further including a mode selector in communication with the control module, the mode selector configured to selectively transmit one of a manual mode signal, a semi-automatic mode signal, and a full automatic mode signal to the control module for operating the locomotive in a mode indicative of one of the mode signals.

14. The locomotive of claim 13, further including a monitoring module in communication with the control module, the monitoring module is remotely located with respect to the control module, the monitoring module is configured to monitor the mode selector, to transmit a mode alert to the control module when the mode selector is selectively changed to one of the manual mode signal and the semi-automatic mode signal while the locomotive is operating in the full automatic mode, and to receive the notification from the control module.

* * * * *